US011944184B2

(12) United States Patent
Stanton

(10) Patent No.: US 11,944,184 B2
(45) Date of Patent: Apr. 2, 2024

(54) SYSTEMS AND METHODS FOR ATTACHING PATCHES TO EQUIPMENT

(71) Applicant: Crosier Products, LLC, Dallas, TX (US)

(72) Inventor: Justin Matthew Stanton, Richmond, TX (US)

(73) Assignee: Crosier Products, LLC, Dallas, TX (US)

( * ) Notice: Subject to any disclaimer, the term of this patent is extended or adjusted under 35 U.S.C. 154(b) by 227 days.

(21) Appl. No.: 17/342,326

(22) Filed: Jun. 8, 2021

(65) Prior Publication Data

US 2021/0386184 A1 Dec. 16, 2021

Related U.S. Application Data

(60) Provisional application No. 63/037,135, filed on Jun. 10, 2020.

(51) Int. Cl.

| | |
|---|---|
| ***A45F 5/00*** | (2006.01) |
| ***A45F 3/04*** | (2006.01) |
| *A45F 3/00* | (2006.01) |

(52) U.S. Cl.

CPC ..... *A45F 5/00* (2013.01); *A45F 3/04* (2013.01); *A45F 2003/001* (2013.01)

(58) Field of Classification Search

CPC ..... A45F 3/04; A45F 3/00; A45F 5/00; A45F 2003/001

See application file for complete search history.

(56) References Cited

U.S. PATENT DOCUMENTS

| | | | | |
|---|---|---|---|---|
| 1,806,162 | A * | 5/1931 | Hahn | A43C 7/04 24/712.9 |
| 9,521,897 | B2 * | 12/2016 | Thompson | A45F 5/02 |
| 9,974,379 | B2 * | 5/2018 | Cole | F42B 39/02 |
| 10,070,699 | B2 * | 9/2018 | Bowerman | A45F 3/00 |
| 10,612,624 | B2 * | 4/2020 | Chen | A47J 45/02 |
| 10,674,804 | B1 * | 6/2020 | Hilliard | A45F 5/02 |
| 10,863,817 | B2 * | 12/2020 | Yeates | F41C 33/046 |
| 10,986,912 | B2 * | 4/2021 | Yeates | A41D 15/00 |
| 11,192,008 | B2 * | 12/2021 | Martell | A45F 3/02 |
| 11,262,161 | B2 * | 3/2022 | Swallow | F41H 1/02 |
| 11,293,479 | B2 * | 4/2022 | Bowerman | F16B 45/06 |
| 11,530,897 | B2 * | 12/2022 | Smith | F41C 33/041 |
| 2017/0318942 | A1 * | 11/2017 | Marui | A45F 3/20 |

* cited by examiner

*Primary Examiner* — Robert Sandy
*Assistant Examiner* — Louis A Mercado
(74) *Attorney, Agent, or Firm* — Johnston IP Law, PLLC

(57) ABSTRACT

In one instance, an attachment device for use in attaching a hook-and-loop patch to Modular Lightweight Load-carrying Equipment (MOLLE) includes a backing member having a central stem and a first cap and a second cap portion. The front side of the device has a hook or loop material applied to it. The first cap has a first wing and second wing. The second cap has a third wing and fourth wing. The backing material is flexible enough to allow the first cap or second cap to be compressed to go through a loop on a MOLLE and then released causing it to return to its original position. In this way, it is attached to a loop on the MOLLE and may then receive a coordinated hook or loop material on the back of a patch. Other embodiments are presented.

15 Claims, 4 Drawing Sheets

SYSTEMS AND METHODS FOR ATTACHING PATCHES TO EQUIPMENT

CROSS-REFERENCE TO RELATED APPLICATION

This application claims the benefit of U.S. Provisional Patent Application 63/037,135, filed on Jun. 10, 2020, entitled, "Attach-a-Patch," which is incorporated herein by reference for all purposes.

TECHNICAL FIELD

This application is directed, in general, to garments, and more specifically, to systems and methods for attaching patches to equipment, namely MOLLE.

BACKGROUND

The following discussion of the background is intended to facilitate an understanding of the present disclosure only. It should be appreciated that the discussion is not an acknowledgement or admission that any of the material referred to was part of the common general knowledge at the priority date of the application.

One way to secure gear on a soldier, law enforcement, or sportsperson is by using Modular Lightweight Load-carrying Equipment, or MOLLE. The MOLLE systems are widely used by both the armed forces and civilians. MOLLE is a load-bearing equipment that uses a modularity provided by straps. It has pouch attachment ladder systems (PALS) that include webbing equipment as rows of straps. The straps are often heavy-duty nylon stitched onto a vest, garment, or other equipment. At times, it might be desirable to add a patch to MOLLE.

Accessories, e.g., a knife harness, may be secured to the MOLLE webbing using accessory straps that are threaded through the loops. They are used for tactical vests, hunting vests, backpacks, equipment belts, hats, hydration packs, etc.

SUMMARY

According to an illustrative embodiment, an attachment device for use in attaching a hook-and-loop patch to Modular Lightweight Load-carrying Equipment, MOLLE, includes a backing member shaped like two cross sections of a mushroom placed with their stems together. The backing member has a first side and a second side. The backing member includes a central stem and a first cap and a second cap portion. The first cap has a first wing on a first lateral edge and a second wing on a second lateral edge. The second cap has a third wing on the first lateral edge and a fourth wing on the second lateral edge.

The first cap is formed by a first channel cutout of the backing member between a portion of the first wing and the central stem, a second channel cutout of the backing member between a portion of the second wing and the central stem, a first central longitudinal cut out of the backing member extending inboard from the first lateral edge, and a second central longitudinal cut out of the backing member extending inboard from the second lateral edge. The second cap is formed by a third channel cutout of the backing member between a portion of the third wing and the central stem, a fourth channel cutout of the backing member between a portion of the fourth wing and the central stem, the first central longitudinal cut out of the backing member, and the second central longitudinal cut out of the backing member.

The attachment device further includes a first hook or loop material attached on at least a portion of a first side of the backing material. The backing material is a flexible material that is flexible enough to have the first or second cap compressed while going through a strap loop on a MOLLE, and wherein the central stem is sized smaller than the width of the strap loop on the MOLLE whereby the attachment device is attached to the MOLLE and presents the hook or loop material outward facing on at least one of the first wing, second wing, third wing, fourth wing, the first cap, and the second cap.

According to another illustrative embodiment, a method of releasably attaching a patch having a hook or loop of a hook-and-loop attachment material on one side to a Modular Lightweight Load-carrying Equipment includes providing an attachment device of the type just summarized. The method further includes compressing the first wing and second wing or third wing and fourth wing towards each other and inserting the same through a loop on the MOLLE so that the central stem is in the loop and allowing the first and second wing or third and fourth wing to separate, whereby the hook or loop material on the first of the backing material of the first cap and the second cap is outward facing. The method also includes applying the hook or loop material of the patch to the hook or loop material of the device to secure the patch to the MOLLE.

According to another illustrative embodiment, an attachment device for use in attaching a hook-and-loop patch to Modular Lightweight Load-carrying Equipment, MOLLE, having a rectangular shaped backing material having a first side and a second side. A hook or loop type material of a hook-and-loop attachment system is on the first side of the backing material. The rectangular shaped backing material has a top longitudinal edge, a bottom longitudinal edge, a first lateral edge, and a second lateral edge. The attachment device further includes a punchout channel formed on the rectangular shaped backing material extending from the bottom longitudinal edge looks like an American football goal post having a left post, right post, connecting portion between the left post and right post, and a base post. The base post is a cutout that is between 10% and 50% of a length of the bottom longitudinal edge.

The attachment device further includes a flap that is formed as material between the left post and right post of the punchout channel. A portion of the backing material from the first lateral edge to the left post is sized and configured to fit into a loop of the Modular Lightweight Load-carrying Equipment. A portion of the backing material from the second lateral edge to the right post is sized and configured to fit into a loop of the Modular Lightweight Load-carrying Equipment. The flap is presented to receive hook or loop material on patch.

According to still another illustrative embodiment, a method of releasably attaching a patch having a hook or loop of a hook-and-loop attachment material on one side to a Modular Lightweight Load-carrying Equipment, MOLLE, includes providing an attachment device of the type summarized in the previous embodiment and placing the portion of the backing material from the first lateral edge to the left post through a loop of the Modular Lightweight Load-carrying Equipment. The method further includes placing the portion of the backing material from the second lateral edge to the right post through another loop of the Modular Lightweight Load-carrying Equipment, whereby the flap is presented to receive hook or loop material on patch. The method also includes applying the hook or loop material of the patch to the hook or loop material of the device to secure the patch to the MOLLE. Other embodiments are presented herein.

DESCRIPTION OF THE DRAWINGS

Illustrative embodiments of the present invention are described in detail below with reference to the attached drawing figures, which are incorporated by reference herein and wherein.

DETAILED DESCRIPTION

In the following detailed description of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims.

Unless otherwise indicated, as used throughout this document, "or" does not require mutual exclusivity.

Modular Lightweight Load-carrying Equipment, or MOLLE, are systems that are useful for carrying many different devices or items of equipment and are widely used by those in the armed forces as well as civilians. MOLLE is a load-bearing equipment that uses a modularity provided by straps. It has pouch attachment ladder systems (PALS) that include webbing equipment as rows of straps. The straps are often heavy-duty nylon stitched onto a vest, garment, or other equipment. Accessories, e.g., a knife harness, may be secured to the MOLLE webbing or straps by using accessory straps that are threaded through the webbing loops. They are used for tactical vests, hunting vests, backpacks, equipment belts, hats, hydration packs, etc. At times, it might be desirable to add a patch to MOLLE and would be desirable to add a hook-and-loop, e.g., VELCRO brand attachment, patch to the MOLLE. The systems and methods presented herein allow for the easy attachment of a hook-and-loop patch to a MOLLE.

Figure 1:
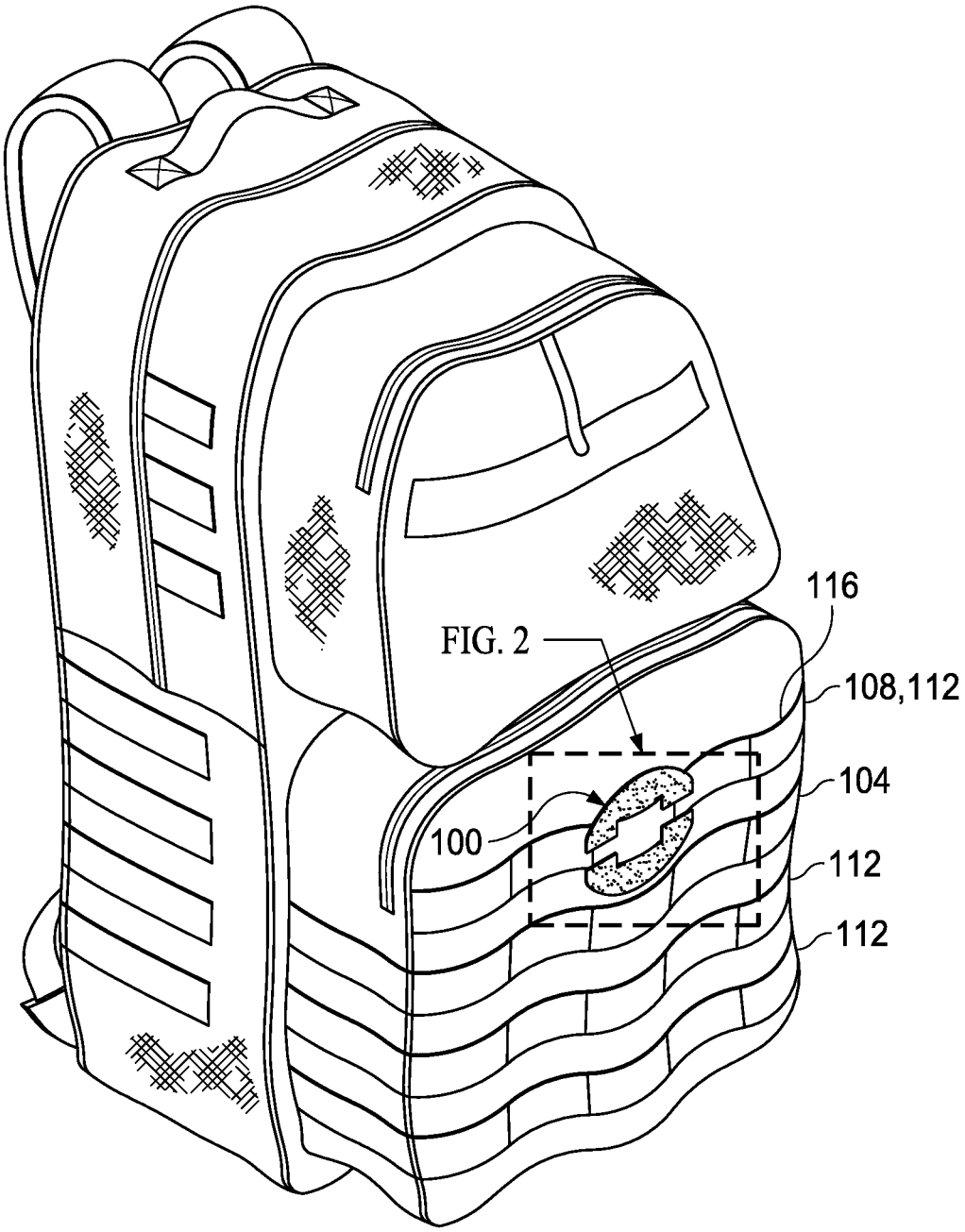
FIG. 1 is a schematic, perspective view of a backpack with a Modular Lightweight Load-carrying Equipment (MOLLE) and presenting an illustrative embodiment of an attachment device for attaching a hook-and-loop patch to the MOLLE.

Referring now to the figures and initially to FIG. 1, an attachment device 100 for use in attaching a hook-and-loop patch (e.g., see 212 in FIG. 6) to Modular Lightweight Load-carrying Equipment (MOLLE) 104. In this example, the MOLLE 104 is a backpack. The MOLLE includes a pouch attachment ladder system (PALS) 108 that includes webbing equipment as rows of straps 112 typically forming loops 116.

Figure 2:
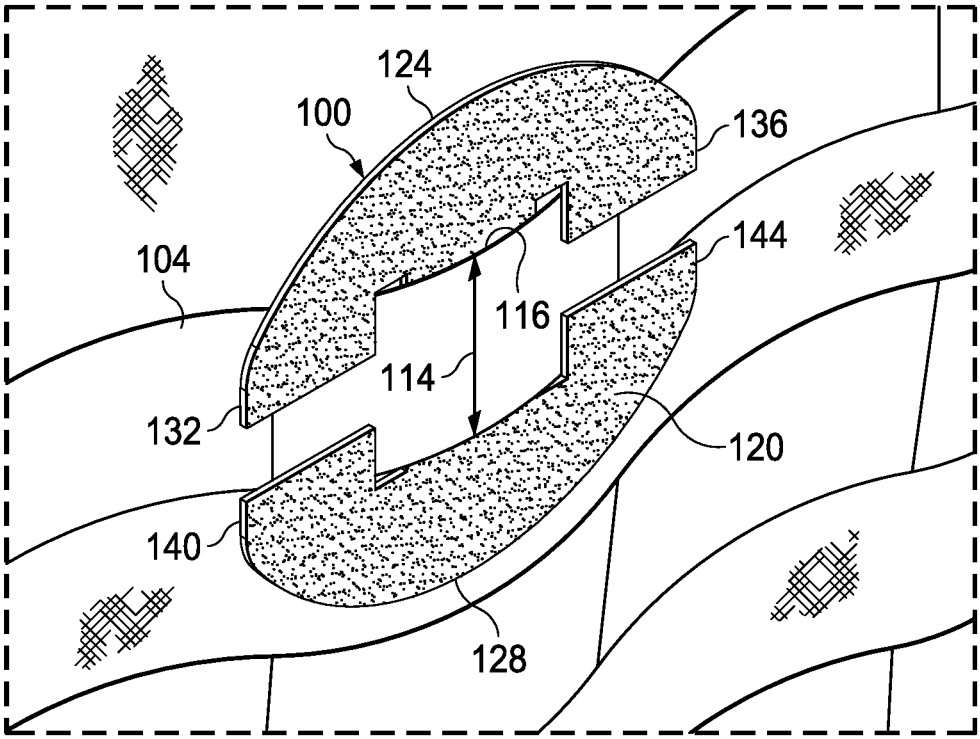
FIG. 2 is a detailed view of a portion of FIG. 1.
Figure 3:
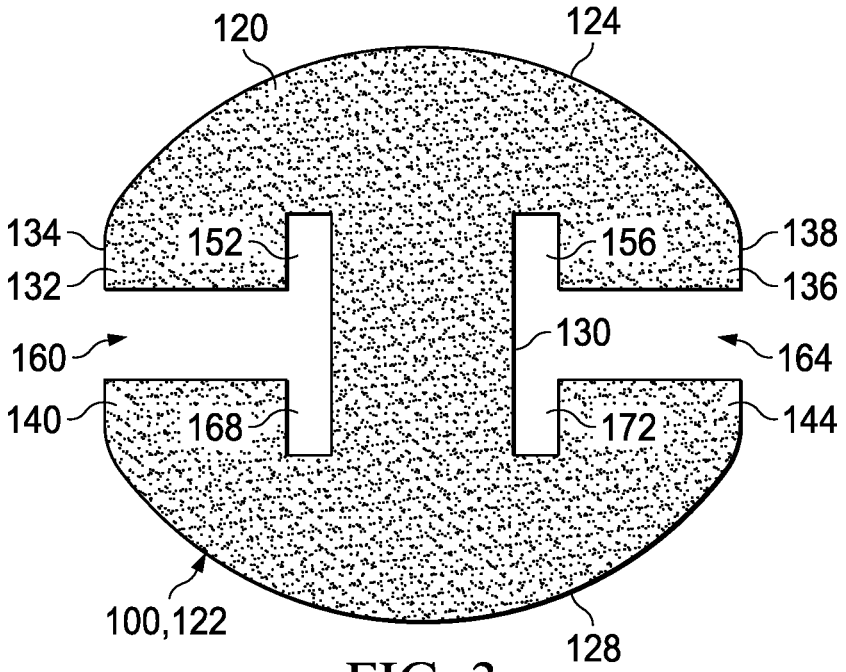
FIG. 3 is a schematic plan view of an illustrative embodiment of an attachment device for releasably attaching a Patch to a MOLLE.
Figure 4:
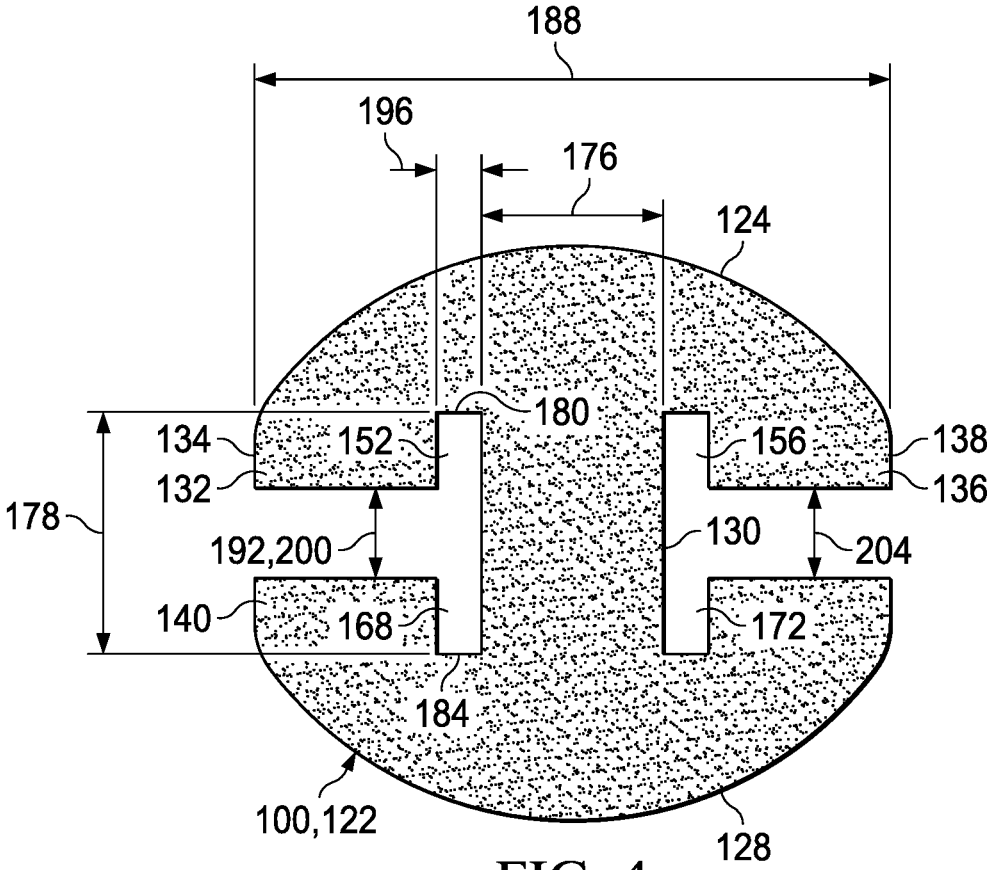
FIG. 4 is the same as FIG. 3 but showing certain dimensions.

Referring now primarily to FIGS. 2-4, and initially to FIG. 2, a detail from FIG. 1 is shown having the attachment device 100 applied within a loop 116 of the MOLLE 104. The attachment device 100 in the installed position presents hook or loop material 120 outward facing to receive coordinated hook or loop material on a patch (see, e.g., 212 in FIG. 6) and thereby secure the patch to the MOLLE 104. The attachment device 100 includes a backing material 122 (FIG. 3), or backing member, cut or formed to have a first cap 124, or first cap portion, and a second cap 128, or second cap portion. A central stem 130 couples the first cap 124 and the second cap 128.

The first cap 124 has a first wing 132 and a second wing 136. The first wing is on a first lateral edge 134, and the second wing 136 is on a second lateral edge 138. The second cap 128 has a third wing 140 and a fourth wing 144. The third wing 140 is on the first lateral edge 134, and the fourth wing 144 is on the second lateral edge 138. A central stem 130 couples the first cap 124 and the second cap 128. One can see that backing member is thus cut or formed in a way that resembles two cross sections of a mushroom placed with their stems together.

The first cap 124 is formed by a first channel cutout 152 of the backing member 122 between a portion of the first wing 132 and the central stem 130, a second channel cutout 156 of the backing member 122 between a portion of the second wing 136 and the central stem 130, a first central longitudinal cut out 160 of the backing member 122 extending inboard from the first lateral edge 134, and a second central longitudinal cut out 164 of the backing member 122 extending inboard from the second lateral edge 138.

Similarly, the second cap is formed by a third channel cutout 168 of the backing member 122 between a portion of the third wing 140 and the central stem 130, a fourth channel cutout 172 of the backing member 122 between a portion of the fourth wing 144 and the central stem 130, the first central longitudinal cut out 160 of the backing member 122, and the second central longitudinal cut out 164 of the backing member 122.

The backing material 122 is covered in whole or in part by hook or loop material of a hook-and-loop attachment material, e.g., VELCRO material. The hook or loop material may cover one or more of the first wing 132, second wing 136, third wing 140, fourth wing 144, the first cap 124, and the second cap 128.

In application, the backing material 122 comprises a flexible material that is flexible enough to have the first cap 124 or second cap 128 compressed—folded with fingers—while going through a strap loop 116 (FIG. 2) on a MOLLE 104. The central stem 130 is sized smaller than the width of the strap loop 116 on the MOLLE 104, whereby the attachment device 100 is attached to the MOLLE 104 and presents the hook or loop material outward facing on at least one of the first wing 132, second wing 136, third wing 140, fourth wing 144, the first cap 124, and the second cap 128.

Those skilled in the art will appreciate the dimensions of the attachment device 100 of FIGS. 1-3 may be varied in part and still work properly. With reference to FIG. 4, illustrative examples of dimensions are provided. In one illustrative embodiment, the central stem 130 has a width 176 of 0.75 inches and in another in the range of 0.6 to 0.85 inches. In one illustrative embodiment, a dimension 178 from an end 180 of the first channel cutout 152 to an end 184 of the third channel cutout 168 is 1.25 inches, and in another in the range of 1.10 to 1.0 inches. In one illustrative embodiment, a dimension 188 from the first lateral edge 134 to the second lateral edge 138 is 2.5 inches, and in another is in the range of 2.25 to 2.75. In one illustrative embodiment, a dimension 192 from an end of the first wing 132 to an end of the third wing 140 is 0.375 inches, and in another is in the range of 0.35 to 0.5 inches. In one illustrative embodiment, the first channel cutout 152 has a width 196 of 0.25 inches, and in another is in the range of 0.2 to 0.3 inches. In one illustrative embodiment, the backing materials 122 is 0.063 inches and in another is in the range of 0.04 to 0.08 inches thick. Those skilled in the art will appreciate that dimension may be varied in different applications.

In one illustrative embodiment, a gap 200 between an end of the first wing 132 and an end of the fourth wing 140, which opposes the first wing 132, and the first channel cutout 152 and the third channel cutout 168 together form the appearance of "T" that has been cut out of the backing material 122. In one illustrative embodiment, a gap 204 between an end of the second wing 138 and an end of the fourth wing 144, which opposes the second wing 138, and the second channel cutout 156 and the fourth channel 172 cutout together form the appearance of "T" that has been cut out of the backing material.

In one illustrative embodiment of the attachment device 100, the central stem 130 has a width 176 of between 0.5 and 0.9 inches; a dimension 178 from an end 180 of the first channel cutout 152 to an end 184 of the third channel cutout 168 is between 1.0 and 1.5 inches; a dimension 188 from the first lateral edge 134 to the second lateral edge 138 is between 2.0 and 3.0 inches; a dimension 192 from an end of the first wing 132 to an end of the third wing 140 is between 0.25 and 0.5 inches; and the first channel cutout 152 has a width between 0.15 and 0.35 inches.

In one illustrative embodiment of the attachment device 100, the first cap 124 and the second cap 128 have flat external longitudinal edges.

In one illustrative embodiment of the attachment device 100, a dimension from an end 180 of the first channel cutout 152 to an end 184 of the third channel cutout 168 is between 101% and 110% of a width 114 (FIG. 2) of a loop 116 of the MOLLE 104.

Figure 5:
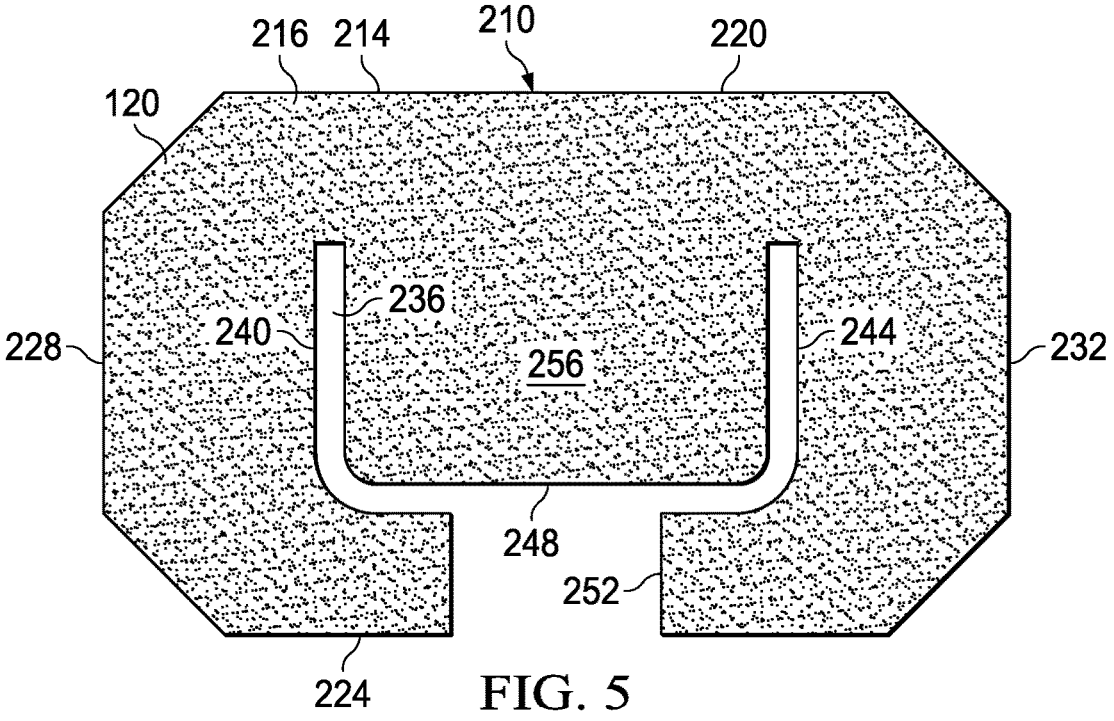
FIG. 5 is a schematic plan view of another illustrative embodiment of an attachment device for attaching a hook-and-loop patch to a MOLLE.
Figure 6:
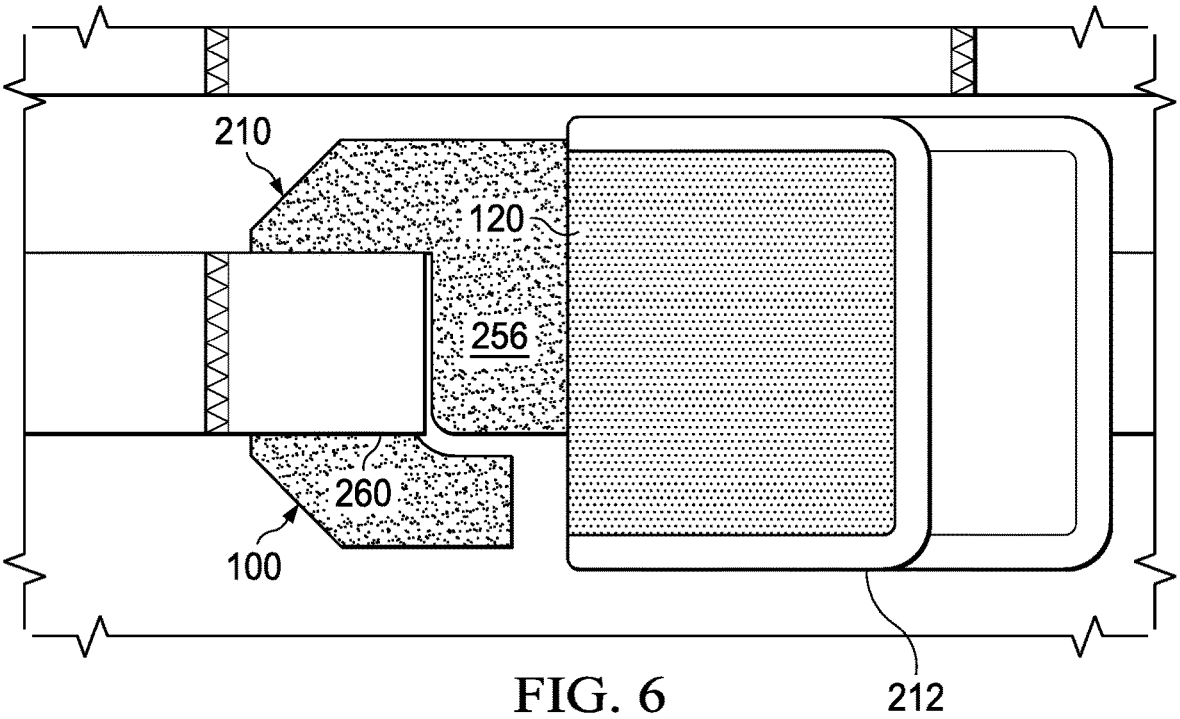
FIG. 6 is an illustrative perspective view a patch being applied to the attachment device of FIG. 5 on a MOLLE.

Referring to now primarily to FIGS. 5-6, another embodiment of an attachment device 210 for attaching a patch 212 to MOLLE 104 (FIG. 1) is presented. The attachment device 210 has a rectangular shaped backing material 214 having a first side 216 and an opposing second side. A hook or loop type material 120 of a hook-and-loop attachment system is on the first side 216 of the backing material 214. The rectangular shaped backing material 214 has a top longitudinal edge 220, a bottom longitudinal edge 224, a first lateral edge 228, and a second lateral edge 232. The corners of the rectangular shaped backing material 214 may be rounded or angled as shown or may be squared.

The attachment device 210 is formed with a punchout channel 236 formed on the rectangular shaped backing material 214 and extending from the bottom longitudinal edge 224 resembles an American football goal post having a left post 240, right post 244, a connecting portion 248 and base post 252. The base post 252, which appears wider than the posts 240, 244, is a cutout that is between 10% and 50% of a length of the bottom longitudinal edge 224 in one illustrative embodiment. This arrangement forms a flap 256 that is the material between the left post 240 and right post 244 of the punchout channel 236. A portion of the backing material 214 from the first lateral edge 228 to the left post 240 is sized and configured to fit into a loop 260 (FIG. 5) of the MOLLE 104 (FIG. 1). A portion of the backing material 214 that extends from the second lateral edge 232 to the right post 244 is also sized and configured to fit into a loop (analogous to loop 260 of FIG. 6) of the MOLLE 104 (FIG. 1). The flap 256 has hook or loop material 120 that is presented to receive coordinated hook or loop material 120 on patch 212.

In one illustrative embodiment of the attachment device 210, the left post 240 and right post 244 of the punchout channel 236 each has a length that is between 50 and 70% of a dimension of the first lateral edge 228. In one illustrative embodiment of the attachment device 210, with respect to the left post 240 and right post 244 of the punchout channel 236, each has a length that sizes the flap to be received in a loop of a MOLLE.

According to one illustrative embodiment, a method of attaching a patch, e.g., patch 212 (FIG. 6) having a hook or loop material 120 one side (back side) to a MOLLE 104 using an attachment device 100 is presented. The method includes providing an attachment device 100 of the type shown and described in FIGS. 1-4. The method further includes compressing the first wing 132 and second wing 136 or third wing 140 and fourth wing 144 towards each other and inserting the same through a loop (e.g., loop 116, 260) on the MOLLE 104 so that the central stem 130 is in the loop and allowing the first wing 132 and second wing 136 or third 140 and fourth wing 144 to separate, whereby the hook or loop material on the first of the backing material 122 of the first cap 124 and the second cap 128—or some portion thereof—is outward facing. The method also includes applying the hook or loop 120 material of the patch 212 to the hook or loop material 120 of the device 100 to secure the patch 212 to the MOLLE 104.

According to another illustrative embodiment, a method is provided for attaching a patch to a MOLLE using an attachment device 210 of the type shown in FIGS. 5 and 6. The method includes providing an attachment device 210 of the type shown and described in FIGS. 5-6. The method further includes placing the portion of the backing material from the first lateral edge to the left post through a loop of the Modular Lightweight Load-carrying Equipment. The method further includes placing the portion of the backing material from the second lateral edge to the right post through another loop of the Modular Lightweight Load-carrying Equipment, whereby the flap is presented to receive hook or loop material on the patch. The method also includes applying the hook or loop material of the patch to the hook or loop material of the device to secure the patch to the MOLLE.

It should be appreciated that attaching of patches is referenced herein, but the "patch" may be any device that is generally laminar with hook or loop material applied to one side.

According one illustrative embodiment, an attached device for releasably securing a patch to a MOLLE includes a front surface that is further comprised of a loop fabric that allows the hooked back of a patch to be secured to the front surface. Further, the back of the device is comprised of a plurality of MOLLE attachment loops and is also comprised of a plurality of plastic clasps that secure the panel and keeps the patch in place.

In one illustrative embodiment, an attachment device for use in attaching a hook-and-loop patch to a MOLLE includes a backing member having a central stem and a first cap and a second cap portion. The front side of the device has a hook or loop material applied to it. The first cap has a first wing and second wing. The second cap has a third wing and fourth wing. The backing material is flexible enough to allow the first cap or second cap to be compressed to go through a loop on a MOLLE and then released causing it to return to its original position. In this way, it is attached to a loop on the MOLLE and may then receive a coordinated hook or loop material on the back of a patch.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. An attachment device for use in attaching a hook-and-loop patch to a carrying system having exterior webbing in a form of a plurality of rows of straps forming a plurality of strap loops, the attachment device comprising:

a backing member shaped like two cross sections of a mushroom placed with their stems together, the backing member has a first side and a second side;

wherein the backing member comprises a central stem and a first cap portion and a second cap portion;

wherein the first cap portion comprises a first wing on a first lateral edge and a second wing on a second lateral edge;

wherein the second cap portion comprises a third wing on the first lateral edge and a fourth wing on the second lateral edge;

wherein the first cap portion is formed by a first channel cutout of the backing member between a portion of the first wing and the central stem, a second channel cutout of the backing member between a portion of the second wing and the central stem, a first central longitudinal cut out of the backing member extending inboard from the first lateral edge, and a second central longitudinal cut out of the backing member extending inboard from the second lateral edge;

wherein the second cap portion is formed by a third channel cutout of the backing member between a portion of the third wing and the central stem, a fourth channel cutout of the backing member between a portion of the fourth wing and the central stem, the first central longitudinal cut out of the backing member, and the second central longitudinal cut out of the backing member;

a first of a hook or loop material attached on at least a portion of a first side of the backing member; and wherein, in application, the backing member comprises a flexible material that is flexible enough to have the first cap portion or the second cap portion compressed while going through a strap loop on the carrying system, and wherein the central stem is sized smaller than a width of each of the plurality of strap loops on the carrying system whereby the attachment device is attached to the carrying system and presents the hook or loop material outward facing on at least one of the first wing, the second wing, the third wing, the fourth wing, the first cap portion, and the second cap portion.

2. The attachment device of claim 1, wherein the hook or loop material is outward facing on the first wing, the second wing, the third wing, the fourth wing, the first cap portion, and the second cap portion.

3. The attachment device of claim 1, wherein the central stem has a width of 0.75 inches, and wherein a dimension from an end of the first channel cutout to an end of the third channel cutout is 1.25 inches.

4. The attachment device of claim 1, wherein a dimension from the first lateral edge to the second lateral edge is 2.5 inches, and wherein a dimension from an end of the first wing to an end of the third wing is 0.375 inches.

5. The attachment device of claim 1, wherein the first channel cutout has a width of 0.25 inches.

6. The attachment device of claim 1, wherein a gap between an end of the first wing and an end of the third wing, which opposes the first wing, and the first channel cutout and the third channel cutout together form an appearance of "T" that has been cut out of the backing member.

7. The attachment device of claim 1, wherein:

the central stem has a width of between 0.5 and 0.9 inches;

a dimension from an end of the first channel cutout to an end of the third channel cutout is between 1.0 and 1.5 inches;

a dimension from the first lateral edge to the second lateral edge is between 2.0 and 3.0 inches;

a dimension from an end of the first wing to an end of the third wing is between 0.25 and 0.5 inches; and the first channel cutout has a width between 0.15 and 0.35 inches.

8. The attachment device of claim 1, wherein a gap between an end of the first wing and an end of the third wing, which opposes the first wing, and the first channel cutout and the third channel cutout together form an appearance of "T" that has been cut out of the backing member; and a gap between an end of the second wing and an end of the fourth wing, which opposes the second wing, and the second channel cutout and the fourth channel cutout together form an appearance of "T" that has been cut out of the backing member.

9. The attachment device of claim 1, wherein a gap between an end of the first wing and an end of the third wing, which opposes the first wing, and the first channel cutout and the third channel cutout together form an appearance of "T" that has been cut out of the backing member;

a gap between an end of the second wing and an end of the fourth wing, which opposes the second wing, and the second channel cutout and the fourth channel cutout together form an appearance of "T" that has been cut out of the backing member;

the central stem has a width of between 0.5 and 0.9 inches;

a dimension from an end of the first channel cutout to an end of the third channel cutout is between 1.0 and 1.5 inches;

a dimension from the first lateral edge to the second lateral edge is between 2.0 and 3.0 inches;

a dimension from an end of the first wing to an end of the third wing is between 0.25 and 0.5 inches; and the first channel cutout has a width between 0.15 and 0.35 inches.

10. The attachment device of claim 1, wherein the first cap portion and the second cap portion have flat external longitudinal edges.

11. The attachment device of claim 1, wherein a dimension from an end of the first channel cutout to an end of the third channel cutout is between 101% and 110% of the width of each of the plurality of strap loops of the carrying system.

12. In combination, a patch having a first hook or loop material on a back side and an attachment device for use in attaching the patch to a carrying system having exterior webbing in the form of a plurality of rows of straps forming a plurality of strap loops, wherein the attachment device comprises:

a resilient, flexible member comprising:

a backing member having a wide top end and a stem that extends from the wide top end, wherein the stem is sized to fit within a loop of the plurality of strap loops of the carrying system, wherein the resilient, flexible member able to be folded by hand to a smaller size and when released will return to its original position, and wherein the wide top end having a width greater than the loop of the plurality of strap loops of the carrying system; and a second hook or loop material, which is complimentary for mating with the first hook or loop material, forming a hook-and-loop attachment system secured to at least a portion of an outward facing surface of the resilient, flexible member for mating with the first hook or loop material on the back side of the patch.

13. The combination as set forth in claim 12, wherein the resilient, flexible member is shaped like two cross sections of a mushroom placed with their stems together, and wherein the resilient, flexible member comprises a central stem and a first cap portion and a second cap portion.

14. A method of releasably attaching a patch having a hook or loop of a hook-and-loop attachment material on one side to a carrying system having exterior webbing in a form of a plurality of rows of straps forming a plurality of strap loops, the method comprising:

providing an attachment device comprising:

a backing member shaped like two cross sections of a mushroom placed with their stems together, the backing member has a first side and a second side, wherein the backing member comprises a central stem and a first cap portion and a second cap portion, wherein the first cap portion comprises a first wing on a first lateral edge and a second wing on a second lateral edge, wherein the second cap portion comprises a third wing on the first lateral edge and a fourth wing on the second lateral edge, wherein the first cap portion is formed by a first channel cutout of the backing member between a portion of the first wing and the central stem, a second channel cutout of the backing member between a portion of the second wing and the central stem, a first central longitudinal cut out of the backing member extending inboard from the first lateral edge, and a second central longitudinal cut out of the backing member extending inboard from the second lateral edge, and wherein the second cap portion is formed by a third channel cutout of the backing member between a portion of the third wing and the central stem, a fourth channel cutout of the backing member between a portion of the fourth wing and the central stem, the first central longitudinal cut out of the backing member, and the second central longitudinal cut out of the backing member, a first of a hook or loop material attached on at least a portion of a first side of the backing member, and wherein, in application, the backing member comprises a flexible material that is flexible enough to have the first cap portion or the second cap portion compressed while going through a strap loop on the carrying system, and wherein the central stem is sized smaller than a width of the strap loop on the carrying system whereby the attachment device is attached to the carrying system and presents the hook or loop material outward facing on at least one of the first wing, the second wing, the third wing, the fourth wing, the first cap portion, and the second cap portion;

compressing the first wing and the second wing or the third wing and the fourth wing towards each other and inserting the same through the strap loop on the carrying system so that the central stem is in the strap loop and allowing the first wing and the second wing or the third wing and the fourth wing to separate, whereby the hook or loop material on the first side of the backing member of the first cap portion and the second cap portion is outward facing; and applying the hook or loop of the patch to the hook or loop material of the attachment device to secure the patch to the carrying system.

15. The method of claim 14, wherein a gap between an end of the first wing and an end of the third wing, which opposes the first wing, and the first channel cutout and the third channel cutout together form an appearance of "T" that has been cut out of the backing member.

* * * * *